US005597967A

United States Patent [19]

Ritter et al.

[11] Patent Number: 5,597,967

[45] Date of Patent: Jan. 28, 1997

[54] ALUMINUM-SILICON ALLOY FOILS

[75] Inventors: Ann M. Ritter, Albany; Melvin R. Jackson, Niskayuna; John R. Hughes, Scotia, all of N.Y.

[73] Assignee: General Electric Company, Schenectady, N.Y.

[21] Appl. No.: 265,890

[22] Filed: Jun. 27, 1994

[51] Int. Cl.[6] ..... C22C 1/04; C22C 21/04; B22F 3/14

[52] U.S. Cl. ..... 75/249; 75/228; 419/3; 419/28; 419/49

[58] Field of Search ..... 75/228, 249; 419/3, 419/28, 49

[56] References Cited

U.S. PATENT DOCUMENTS

| | | | |
|---|---|---|---|
| 1,944,183 | 1/1934 | Kempf | 148/21.1 |
| 3,728,089 | 4/1973 | Segawa et al. | 29/182.5 |
| 4,099,314 | 7/1978 | Perrot et al. | 29/420 |
| 4,155,756 | 5/1979 | Perrot et al. | 25/231 |
| 4,174,232 | 11/1979 | Lenz et al. | 148/2 |
| 4,196,262 | 4/1980 | Pryor et al. | 428/654 |
| 4,211,827 | 7/1980 | Pryor et al. | 428/654 |
| 4,230,489 | 10/1980 | Antill | 75/124 |
| 4,266,186 | 5/1981 | Ruhle | 324/65 R |
| 4,435,212 | 3/1984 | Ueshima et al. | 75/124 |
| 4,847,044 | 7/1989 | Ghosh | 419/8 |
| 5,030,277 | 7/1991 | Eylon et al. | 75/229 |
| 5,409,156 | 4/1995 | Tsuji et al. | 228/120 |

OTHER PUBLICATIONS

"Processing and Properties of Gamma Titanium Aluminide Sheet Produced From Prep Powder", M A Ohls, et al., Nuclear Metals Inc., 1991—Powder Metal in Aerospace and Defense Technologies, pp. 289–296.

"Temperature Transients During Hot Pack Rolling of High Temperature Alloys", S L Semiatin, et al., Scripta Metallurgica, vol. 25, pp. 1851–1856, 1991.

"Superalloy Foils by Hot Isostatic Pressing" Ritter et al., S. N. 08/194,967, filed Feb. 14, 1994. (RD–22,147).

"Method of Making Metal Alloy Foils", A M Ritter, et al., Ser. No. 08/223,345, filed Apr. 5, 1994. (RD–22,069).

"Apparatus for Making Metal Alloy Foils" A M Ritter, et al., Ser. No. 08/223,347, filed Apr. 5, 1994. (RD–23,555).

"Oxide Dispersion Strengthened Alloy Foils", A M Ritter, et al., Ser. No. 08/265,892, filed Jun. 27, 1994. (RD–22,187).

"Metal Alloy Foils", A M Ritter, et al., Ser. No. 08/265,893, filed Jun. 27, 1994. (RD–22,186).

"NI–Base Alloy Foils", A M Ritter, et al., Ser. No. 08/265, 891, filed Jun. 27, 1994. (RD–22,196).

*Primary Examiner*—Donald P. Walsh
*Assistant Examiner*—Daniel J. Jenkins
*Attorney, Agent, or Firm*—James Magee, Jr.

[57] ABSTRACT

Two-phase Al—Si alloy foils are made directly from Al—Si alloy powders by hot pressing. These Al—Si alloy foils are characterized by having a thickness of 0.017 in. or less, and by the fact that they are fine-grained and substantially free of oxygen, nitrogen and deformation-induced defects. The as-pressed Al—Si foils where the primary phase is the Al solid-solution phase are also generally ductile and adapted for subsequent forming operations, including cold rolling. The reduction in thickness imparted in a single pass to an Al-11.6Si alloy foil through cold-rolling was at least about 10%, with up to about 90% reduction in thickness accomplished by a plurality of such passes. These reductions in thickness were accomplished without stress relief annealing, but such annealing may be employed if desirable for microstructural modification.

17 Claims, 2 Drawing Sheets

ALUMINUM-SILICON ALLOY FOILS

CROSS-REFERENCE TO RELATED APPLICATIONS

The subject application is related to the following co-pending U.S. patent applications: Ser. No. 08/194,967, filed Feb. 14, 1994; U.S. Pat. No. 5,427,736; Ser. No. 08/223,347, filed Apr. 5, 1994; Ser. No. 08/265,893, filed Jun. 27, 1994; Ser. No. 08/265,892, filed Jun. 27, 1994; and Ser. No. 08/265,891, filed Jun. 27, 1994; all of which are herein incorporated by reference.

FIELD OF THE INVENTION

The present invention is related generally to metal alloy foils. More particularly, the invention comprises metal alloy foils, and specifically two-phase Al—Si foils, having a thickness of about 0.017 in. or less, which are substantially oxygen and nitrogen free, substantially free of forming or deformation-induced grain orientation or elongation and characterized by a having a fine-grained microstructure. The invention also comprises Al—Si alloy foils made by the method of hot pressing an Al—Si alloy powder to directly form the foil from the powder.

BACKGROUND OF THE INVENTION

Metal alloy foils, particularly of superalloys and other high melting point alloys, are of commercial interest for use in many applications, including the manufacture of metal matrix composites. Other potential applications of metal alloy foils, including foils of lower melting point alloys such as Al—Si alloys, may comprise use as cladding or coating materials to impart specific properties, such as corrosion, wear or oxidation resistance to a particular substrate.

However, the lack of low and/or high temperature ductility of many classes of alloys (or compositional ranges within certain classes of alloys), such as high melting point Ti-base, Ni-base, and Nb-base alloys and lower melting point alloys such as Al—Si alloys, have prevented, or at least limited, the development of metal alloy foils from these alloys. Often this lack of ductility is attributable to the existence of brittle phases, such as intermetallic compounds. These phases may result from segregation in bulk forms, in which case these phases would be absent if the bulk forms were fully homogeneous. This characteristic often limits, or rules out altogether, the use of related art foil-making methods that rely on cold-rolling techniques; since such alloys may not be readily rolled from their bulk forms, such as ingot, slab or sheet forms.

As discussed in the above-referenced patent applications and known generally by those of ordinary skill, related art metal alloys that can be made in foil form are further limited by one or more of the following characteristics: higher than desired concentrations of oxygen and/or nitrogen contaminants, grain orientation or elongation (e.g. grain elongation in a preferred direction) related to existing foil forming methods, and large grains which are either inherent to the starting material used to produce a foil or caused by grain growth related to existing foil forming processes.

Another known limitation of some related art metal alloy foils is that when available, they are costly. This is due in part to bulk material costs, as well as the fact that present methods of making such foils involve costly, complex, multi-step processes which combine various combinations of hot-working, cold-working, annealing and surface finishing, and often may involve substantial loss of the starting materials (e.g. chemical milling to produce Ti-base alloy foils). Also, whether due to cost or other considerations, relatively few high strength metal alloy compositions have been produced in foil form.

SUMMARY OF THE INVENTION

The present invention comprises metal alloy foils made directly from metal alloy powders by means of hot pressing the powder. The invention particularly comprises two-phase Al—Si alloy foils made directly from Al—Si alloy powders by means of hot pressing the powders, including Al—Si alloy foils that are ductile and may be subsequently formed by metal-forming processes including cold-rolling.

The invention also comprises Al—Si alloy foils having a thickness less than or equal to 0.017 in. and which are substantially free of oxygen, nitrogen and deformation-induced grain orientation or elongation.

The invention also comprises Al—Si alloy foils, each made by a method comprising the steps of: selecting an Al—Si alloy powder; loading the Al—Si alloy powder into a means for holding; evacuating the means for holding; hot pressing the means for holding to form an Al—Si alloy foil directly from the Al—Si alloy powder; and removing the means for holding from the Al—Si alloy foil. Foils made by this method may be further modified by the step of forming the foil, such as cold-rolling to reduce the foil thickness or modify the foil properties.

One object of the present invention is to provide Al—Si alloy foils directly from Al—Si alloy powders, thereby avoiding numerous process steps that would be associated with using related art foil-making methods to make such foils and serving as an improvement to them.

A second object of the invention is to provide Al—Si alloy foils which are substantially free of oxygen and/or nitrogen contaminants.

A third object of the invention is to provide Al—Si alloy foils which are substantially free of deformation-induced (e.g. rolling) grain orientation or elongation.

A fourth object of the invention is to provide fine-grained Al—Si alloy foils.

A fifth object of the invention is to provide ductile Al—Si alloy foils.

The ductility of many of the foil compositions which can be made by this method is a significant unexpected advantage, because ductile Al—Si foils have been demonstrated of compositions which are known to be brittle in other forms. This advantage results in Al—Si alloy foils which are capable of being formed in subsequent metal working operations, such as cold-rolling. Therefore, extremely thin foils are possible of alloy compositions that were heretofore either not available in foil form, or else very difficult to reduce to foil form.

DETAILED DESCRIPTION OF THE INVENTION

Figure 1:
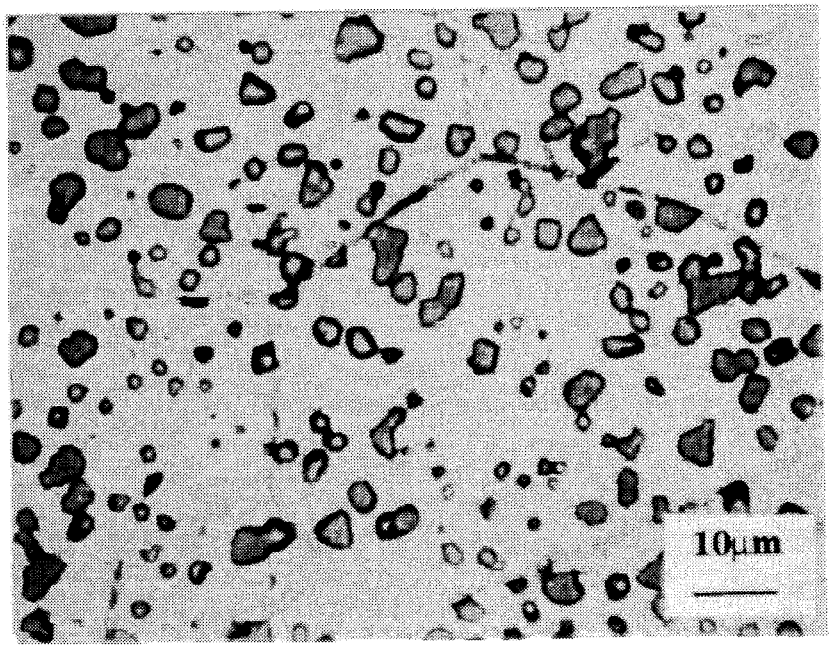
FIG. 1 is an optical photomicrograph taken at 100× magnification of the microstructure of an as-pressed Al-11.6Si (in weight percent) foil as viewed in a plane parallel to the foil surface.

The method of making metal alloy foils described herein is set forth in patent application Ser. No. 08/223,345 filed on Apr. 5, 1994, as referenced above. This reference describes a method of making metal alloy foils directly from a metal alloy powder which comprises the steps of: selecting a metal alloy powder; loading the metal alloy powder into a means for holding; evacuating the means for holding; hot pressing the means for holding to form a metal alloy foil directly from the metal alloy powder; and removing the means for holding from the metal alloy foil. A second reference noted above, patent application Ser. No. 08/223,347 filed on Apr. 5, 1994, describes a preferred embodiment of an apparatus comprising the means for holding described in the method of making.

As used herein, the term "foil" designates a thin layer of metal having a thickness range of about 0.005–0.017 inches in the as hot-pressed condition, except that thicker sheets of material should be included within this definition to the extent that the method of making referenced herein can be utilized to produce ductile forms of alloys such that they may be formed to a thickness within the range described above and likewise, thinner foils should be included within this definition to the extent that they are subsequently formed from foils initially falling within this range. In a preferred embodment, the foils of the present invention have a range of thicknesses of about 0.009–0.013 in. in the as hot-pressed condition.

Applicants have observed that Al—Si alloy foils made using the method referenced herein are also characterized by being substantially free of oxygen, nitrogen and deformation-induced grain orientation or elongation. These foils are also characteristically fine-grained. They also have ambient and/or high temperature ductility in their as-pressed condition, and may be subjected to subsequent metal-forming operations, such as cold-rolling, hot rolling and stamping.

In the context of this application, "substantially oxygen and nitrogen free" means selecting commercially available powders, as part of the foil-making method referenced herein, having controlled concentrations of these elements that are as low as commercially possible in powder form for the particular metal alloy of interest, except in cases where either or both of these elements are considered to be part of the desired alloy composition (e.g. oxide dispersion-strengthened alloys).

"Commercially possible" as used herein is intended to comprise the range of oxygen and nitrogen concentrations which are commercially reasonable to make and thus commercially available. Applicants have determined that foils made by the method referenced herein which are substantially free of oxygen and nitrogen have about the same concentration of oxygen and nitrogen as found in the powders used to make them. Typical concentrations of oxygen and nitrogen within various metal alloy powders are known to those of ordinary skill based on quantitative chemical analysis data frequently supplied by powder manufacturers.

The characteristic of being substantially free of oxygen and nitrogen is important and of particular interest because these elements often represent impurity elements in many metal alloys whose foils have commercial or potential commercial applications, such as Ti-base, Ni-base, Nb-base and Al—Si alloys. This is an important advantage generally of the present invention, because it yields Al—Si alloy foils having reduced concentrations of oxygen and nitrogen as compared to foils made using related art methods of making foils, particularly plasma spraying. Plasma spraying is a method wherein a metal alloy powder is injected into the plume of a plasma spray gun to form molten droplets of the metal alloy which are subsequently deposited onto a chill plate, or suitable collector, so as to form a foil (or pre-foil in instances where a thicker sheet is plasma-sprayed and then subsequently reduced in thickness to the thickness of a foil) of the metal alloy. The method is performed in an evacuated chamber, because it is known that the molten metal alloy droplets formed will react with atmospheric constituents, particularly oxygen and nitrogen. However, it is also known that despite the use of vacuum conditions, the molten metal alloy droplets used to form foils by this method nevertheless react with residual amounts of atmospheric constituents available during the deposition process, particularly oxygen and nitrogen.

For example, Applicants have observed that an alloy powder of Ti-6Al-2Sn-4Zr-2Mo (by weight percent), with measured average oxygen and nitrogen concentrations of approximately 850 wppm (parts per million by weight) O and 100 wppm N, produces an RF plasma-sprayed pre-foil having measured average concentrations of these elements of approximately 1950 wppm O and 140 wppm N. Similarly, in a Ti-14Al-21Nb (by weight percent) alloy, Applicants measured average concentrations of oxygen and nitrogen of approximately 800 wppm O and 80 wppm N in the powder, as compared to average concentrations of 1350 wppm O and 160 wppm N in a foil made from the same powder by plasma spraying.

As a further example, analyses of six commercially available Ni, Co and Fe-base powders of –400 mesh powder size gave average oxygen concentrations of 476 wppm (range of 180–790 wppm O); average nitrogen concentrations were 151 wppm (range of 76–231 wppm N). In dc plasma spraying of thick structures, similar –400 mesh powders resulted in an average of 170 wppm O added beyond that in the powder, and an average of 20 wppm N added beyond that in the powder. Since the first material deposited tends to getter the chamber gases of oxygen and nitrogen, thin foil plasma deposits are expected to show even greater O and N increases.

These increases in oxygen and nitrogen are due to the residual partial pressures of these elements that exist regardless of the absolute pressure of the vacuum chamber used for the deposition. Even small amounts of these elements in the deposition chamber or in the process gases will react with metal alloys in this process due to the large heats of formation associated with most metal oxides and nitrides. The elevated temperature of a metal alloy powder as it is melted to form droplets while passing through a plasma plume provides ideal conditions for the reaction of the residual oxygen and nitrogen with the metal alloy. Hence, even if the same metal alloy powder (e.g. a powder having the lowest commercially possible oxygen and nitrogen content) is used in the method of the present invention and the plasma spraying process, metal alloy foils formed by the plasma spraying method would be expected to have higher concentrations of oxygen and nitrogen, as confirmed by the data presented above. Increased concentrations of these elements can be particularly significant and undesirable in the case of many alloys, such as Ti-base alloys where increased oxygen and nitrogen concentrations are known to increase the tendency to stabilize the brittle alpha titanium phase otherwise known as "hard alpha", and may seriously impact the commercial usefulness of the resultant metal alloy foil.

The oxygen and nitrogen concentrations within metal alloy powders, including Al—Si powders, vary depending on a number of factors, including: manufacturing methods used for making the alloy powders; the nature of the constituents of the alloy (e.g. the heat of formation of the alloy constituents with respect to their stable oxides, nitrides and combinations thereof, including metastable phases); the morphology of the powders (e.g. smooth spherical powders versus rough irregular powders); particle sizes and distributions and other factors.

An example of the variations that may be experienced due to one of these factors, and the significance with respect to the foils of the present invention is described below. The concentrations of oxygen and nitrogen found in powder materials are known to be predominantly due to oxygen and nitrogen contaminants found on the powder surfaces rather than within the powder particles, except where one or more of these elements has been added as an alloy constituent, as in the case of oxide dispersion strengthened (ODS) Ni-base alloys. Thus, the concentrations of these elements for a particular alloy powder will be approximately proportional to the powder size.

For a 1 $cm^3$ volume of consolidated, uniform-size, spherical powders of radius r, the number of particles, n, is given by $((1\ cm^3)/(4\pi r^3/3))$. The surface area of the particles included in that 1 $cm^3$ is given by $4\pi r^2 n$, or substituting for n, the surface area is 3 $cm^3/r$. This leads to the following:

TABLE 1

Surface Area as a Function of Particle Size

| Radius (μm) | Surface area ($cm^2$) |
|---|---|
| 10 | 3,000 |
| 30 | 1,000 |
| 100 | 300 |
| 300 | 100 |
| 1000 | 30 |

Gas atomized powders sieved to −140/+270 mesh include a range of sizes of 53–105 μm diameter (26.5–52.5 μm radius) with an average radius of about 39.5 μm; while those sieved to −400 mesh include particles below 37 μm diameter (18.5 μm radius), which powders have been empirically observed to exhibit an average size of about 12 μm radius. Therefore, as can be seen from Table 1, the finer powder would be expected to have 3.0–3.5 times as much contamination by oxygen and nitrogen due to surface area considerations alone. This also has significance with respect to the related art plasma spraying foil-making method described above. For process related considerations, powders used in direct current low pressure plasma spraying of foils are generally in the −400 mesh size (average radius of about 12 μm) to assure complete melting of the powder particles; while in a preferred embodiment, the powder foil method of the present invention may use much coarser powders, typically on the order of −140/+270 mesh (average radius of about 39.5 μm) to assure good flowability of the powder. Hence, the same alloy powder as normally used in these two processes in two different mesh sizes would typically be expected to have significantly different concentrations of oxygen and nitrogen in the starting powders, even before foil-making process related increases in the concentrations of these elements which are known to occur in the plasma-spraying process.

Based on the data presented above for foils made from Ti-base alloy powders, it will be recognized that the foil-making method described herein may be used to manufacture substantially oxygen and nitrogen free Al—Si foils having about the same concentrations of oxygen and nitrogen as the Al—Si powders from which they are made. Also, when comparing oxygen and nitrogen concentrations of powders of different materials, such as with Al—Si, Ni-base and Ti-base alloys, it is useful to think in terms of atomic concentrations (appm) rather than weight concentrations (wppm) with respect to the significance of the presence of oxygen and nitrogen, because of the different atomic weights of each base element. For example, a concentration of 100 wppm O corresponds to 169 appm O in Al, 299 appm O in Ti, and 367 appm O in Ni. For 100 wppm N, there is 192 appm N in Al, 340 appm N in Ti, and 416 appm N in Ni. Therefore, the ability to produce foils which tend to minimize the concentrations of and are substantially free of oxygen and nitrogen can have varying significance depending on the alloy system being considered, especially in cases where small quantities of these elements can produce significant deleterious consequences in alloy properties, as in the case of hard-alpha in Ti-base alloys as discussed above.

The metal alloy foils of the present invention are also characterized by being "substantially free of deformation-induced defects", particularly grain orientation or elongation which are known to result from the mechanical forming, such as hot-rolling or cold-rolling operations used to a greater or lesser degree in all related art foil-making methods. While grain orientation or elongation may be desirable in some articles, it is most frequently viewed as a defect in thin foils requiring remedial treatment, such as the employment of various annealing operations for stress relief, microstructural change or other purposes. However, it is known that such remedial heat treatments do not completely remove the effects on an alloy microstructure of prior deformation due to such forming operations. For instance, recrystallization anneals, which are typically done at one-third to one-half of the absolute alloy melting temperature or more, typically would result in a recrystallized microstructure that depends substantially on the prior deformed microstructure from which it is recrystallized, for short annealing times. As the time of a recrystallization anneal is increased, the microstructure of a metal alloy foil would tend to undergo grain growth, which may be undesirable for foil products, particularly in applications where foil strength or ductility are important considerations.

Also, deformation-induced defects may be created that are not readily removable by annealing, or perhaps not removable at all, including forming (e.g. rolling) damage to the surface of the foil, strung-out included impurities, strung-out phases of the alloy itself and strung-out internal casting voids.

As may be seen in FIGS. 1–4, metal alloy foils, particularly Al—Si foils, of the present invention are substantially free of the types of defects described above, because anisotropic deformation is not employed to make such foils. FIGS. 1–4 are optical photomicrographs of two representative Al—Si alloys of the present invention which do not exhibit grain elongation or orientation, or any of the other potential deformation-induced defects mentioned above associated with related art foils made using forming techniques. This is yet another substantial advantage of the metal alloy foils of the present invention, not only because elimination of the deformation-induced defects noted above produces foils free of the defects noted and thus suited for a wider variety of purposes, but because methods employed to remove these defects from related art foils may be rather costly. For example, in the case of Ti-base alloy foils made by hot rolling, after rolling to a near-final thickness, the "pre-foil" surfaces are chemically milled in an attempt to remove some of the deformation-induced defects, resulting in substantial material loss.

The metal alloy foils of the present invention are also fine-grained. It is known that the grain size of articles made from powders by the use of hot-pressing techniques tend to approximate the grain size of the powders from which they are made in the as-pressed condition. For example, the grain size of an Al-11.6Si (in weight-percent) foil, a eutectic alpha+beta alloy made by the method described below, was about 10 μm or less for the alpha (Al-rich) phase and about 2–5 μm for the beta (Si-rich phase).

Many of the metal alloy foils made by the method referenced herein, including an Al-11.6Si (in weight percent) alloy also have significant amounts of ambient and/or high temperature ductility as indicated in Table 2.

TABLE 2

TENSILE PROPERTIES OF POWDER FOIL MATERIAL

| Composition (wt. %) | Test Temp. °F. | 0.2% Y.S. (ksi) | U.T.S. (ksi) | Elongation (%) |
|---|---|---|---|---|
| Rene 'N4 (Ni—9.25Cr—7.5Co—6.0W—4.2Ti—4.0Ta—3.7Al—1.5Mo—0.5Nb) (composition only) | 70 | 138 | 202 | 13.1 |
| | 1600 | 78 | 79 | 0.3 |
| | 1800 | 22 | 34 | 2.5 |
| Rene '142 (Ni—12.0Co—6.8Cr—6.15Al—1.5Mo—4.9W—6.35Ta—2.8Re—1.5Hf—0.12C—0.015B—0.01Y) (composition only) | 70 | 124 | 181 | 10.8 |
| | 1400 | 122 | 148 | 5.7 |
| | 1600 | 102 | 113 | 1.3 |
| | 1800 | 44 | 45 | 0.4 |
| Ni—22Cr—10Al—0.8Y | 70 | 125 | 171 | 12.3 |
| | 1830 | 11 | 13 | 10.1 |
| Ni—27Co—16Cr—8Al—6W—0.2Y | 70 | 116 | 165 | 13.3 |
| | 1830 | 8 | 9 | 155 |
| Fe—20Cr—4.5Al—0.5Y | 70 | 62 | 85 | 18.9 |
| | 1400 | 8 | 11 | 72.8 |
| | 1600 | 5 | 6 | 115 |
| | 1800 | 4 | 4 | 53.9 |
| Co—32Ni—21Cr—8Al—0.5Y | 70 | 115 | 142 | 3.7 |
| | 1830 | 7 | 9 | 34.2 |
| MA754 (Ni—20Cr—1.4Fe—0.35Al—0.6—Ti—0.6$Y_2O_3$) (composition only) | 70 | 147 | 149 | 0.6 |
| | 1830 | 7 | 9 | 43.6 |
| Al—11.6Si | 70 | 14 | 20 | 27.1 |

Rene'N4, Rene'142 and MA754 designate tradenames of several well-known Ni-base alloy compositions. The designations "composition only" in Table 2 refer to the fact that tensile properties for these alloys are commonly reported for specific alloy morphologies, such as directionally solidified or single crystal forms of these alloys, which forms would be expected to exhibit significantly different properties than the polycrystalline foils of the present invention.

This ductility is a significant advantage because many of these alloys are known not to exhibit significant ambient and/or high temperature ductility in other forms, such as as-cast ingots. For example, Al—Si alloys where the silicon content is greater than about ten weight percent are known to have virtually no ambient temperature ductility in the as-cast form. As such, foils of these brittle alloys are unknown because related art foil-making methods, which rely on hot and/or cold rolling processes, may not be used to form them.

Another significant unexpected advantage of the present invention was the cold-rollability of one of these alloys, MA754, even though it did not exhibit significant tensile ductility. This is significant because it indicates that other alloys, including Al—Si alloys, made from powders may be cold-rollable even when made from alloy compositions that are known to be brittle in non-foil forms, and even when tensile data indicates that the foil form are not ductile.

Applicants believe that the combination of the distinctive characteristics of Applicants' invention as set forth above offer significant advantages over, and are distinguished from, related art metal alloy foils, particularly Al—Si alloy foils. Further, these metal alloy foils are also distinguished from related art metal alloy foils by virtue of the fact that they are made by the method described herein and in co-pending patent application Ser. No. 08/223,345 filed Apr. 5, 1994, which is incorporated by reference above.

EXAMPLE 1

The method referenced herein was used to make two-phase Al—Si alloy foils. The Al—Si powders were selected such that the primary phase quantitatively of the resultant foils was the alpha (Al solid-solution) phase. However, Applicants believe that foils where the primary phase is the beta (Si solid-solution) phase could be made equally well by selecting the appropriate alloy powder composition and processing conditions, although the resultant foil properties (e.g. ductility) would likely be different. In this context, primary phase refers to the phase occupying about 50 percent or more of a foil by volume. In a two component Al—Si alloy, the secondary phase would refer to the phase occupying 50 percent or less of a foil by volume.

The alloy powders selected in this example were: Al-11.6Si (in weight-percent), a eutectic alpha+beta alloy; Al-11.6Si (in weight percent)+25 vol/o Si, a eutectic Al—Si alloy with pure Si particles; Al-25Si (in weight percent) a hypereutectic alpha+beta alloy. These powders are considered to be substantially oxygen and nitrogen free in view of the discussion and data presented above.

Powder sizes for these alloys are shown in Table 3.

TABLE 3

ALLOY POWDER COMPOSITIONS AND HOT PRESSING CONDITIONS

| Composition (wt. %) | Powder Size Range (mesh) | HIP Conditions |
|---|---|---|
| Al—11.6Si | −140 + 325 | 1065° F./4 hr/15 ksi |
| Al—11.6Si + | −140 + 325 | 1065° F./4 hr/15 ksi |

TABLE 3-continued

ALLOY POWDER COMPOSITIONS AND HOT PRESSING CONDITIONS

| Composition (wt. %) | Powder Size Range (mesh) | HIP Conditions |
|---|---|---|
| 25 vol/o Si | −270 + 325 | |
| Al—25Si | −100 | 1065° F./1 hr/15 ksi |

No effort was made to optimize powder particle sizes for the powders used in this example.

The means for holding are cold-rolled steel hot isostatic press (HIP) cans as described in Example 1 of patent application Ser. No. 08/223,347, referenced above.

In order to load the HIP cans, Mo foil sleeves were flared into funnels and inserted into the openings in the HIP cans, and the HIP cans were placed upright in an ultrasonic cleaner. Powder was then loaded into the cans through the funnels. During loading, the HIP cans were vibrated ultrasonically, and a thin sheet was used as a mechanical ram to pack the powders into the cavity in each HIP can. After loading, the Mo sleeves were removed and the HIP cans were closed. The assemblies were then evacuated and leak-tested, and the evacuated assemblies were baked out under vacuum for 24 hours at 392° F. The steel tubes were then heated, crimped, cut-off and the assemblies sealed by TIG welding the cut end.

HIP was done in an argon atmosphere for the time and under the temperature and pressure conditions listed in Table 3. The HIP cans were then removed by etching in a solution of 50% nitric acid/50% water by volume to release the foils.

With a cavity opening of about 0.015 in. in the HIP cans, the average thickness of the resulting foils was about 0.010–0.011 in., with a range in thickness of 0.009–0.012 in.. As discussed above with respect to FIGS. 1–4, the resulting foils generally had fine-grained microstructures.

Figure 2:
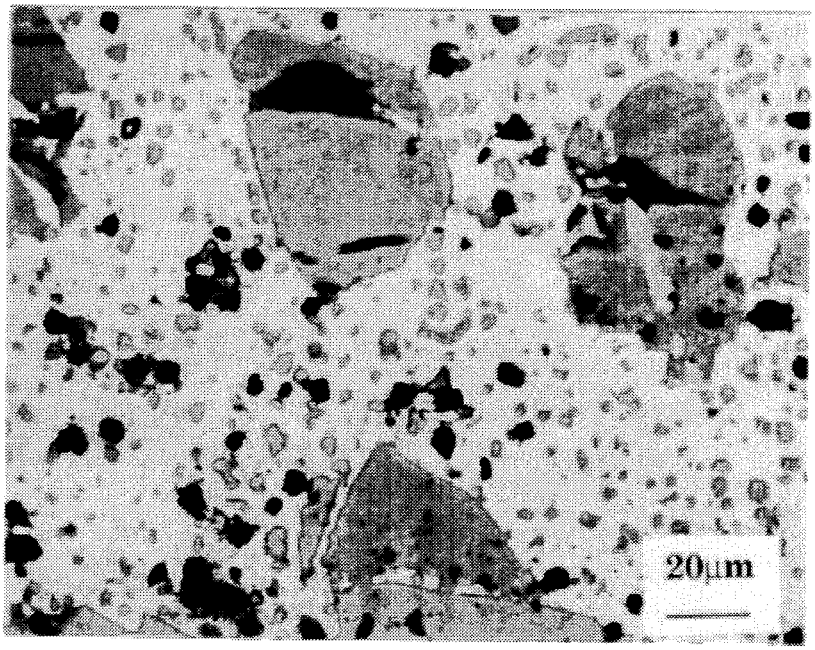
FIG. 2 is an optical photomicrograph taken at 500× magnification of the microstructure of an as-pressed Al-11.6Si (in weight percent)+25 vol/o Si foil as viewed in cross-section through the thickness of the foil.

The microstructure of two of the as-HIP foils are shown in FIGS. 1 and 2. Referring to FIG. 1, the microstructure of the Al-11.6Si comprises a matrix of the Al solid-solution alpha phase with homogeneously distributed Si solid-solution beta particles. The grain size of the Al matrix is about 10 μm or less, and generally between 5–10 μm. The grain size of the Si particles is about 2–5 μm. Referring to FIG. 2, the Al-11.6Si+25 vol/o alloy has a generally similar microstructure as described above for the alloy of FIG. 1, except for the addition of the 25 vol/o of pure Si particles. The added Si particles are larger, about 30–50 μm in diameter, and have an irregular and somewhat angular morphology. The cracks shown in the Si particles of FIG. 2 may result from the metallographic preparation.

Room temperature tensile properties were obtained for the as-HIP Al-11.6Si foil, which had a yield strength of 14 ksi and an ultimate tensile strength of 20 ksi. This is a considerable enhancement of strength over annealed wrought Al, which would be expected to have a yield strength of about 4 ksi and an ultimate strength of about 11 ksi, probably due to the fine grain size of the Al-rich matrix. Some of the increased strength may also be a dispersion strengthening effect due to the presence of the Si particles. The microstructures of both as-pressed alloys were substantially free of deformation-induced defects as described herein.

Cold-rolling of the Al-11.6Si and Al-11.6Si+25 vol/o Si foils was done using a stainless steel pack, made of steel sheets approximately 0.022–0.025 in. thick. The average amount of reduction per pass for the foils was about 10%. After each pass, the thickness, length and width of the foils were measured, and the edges and surfaces of the foils were examined visually for cracking.

Figure 3:
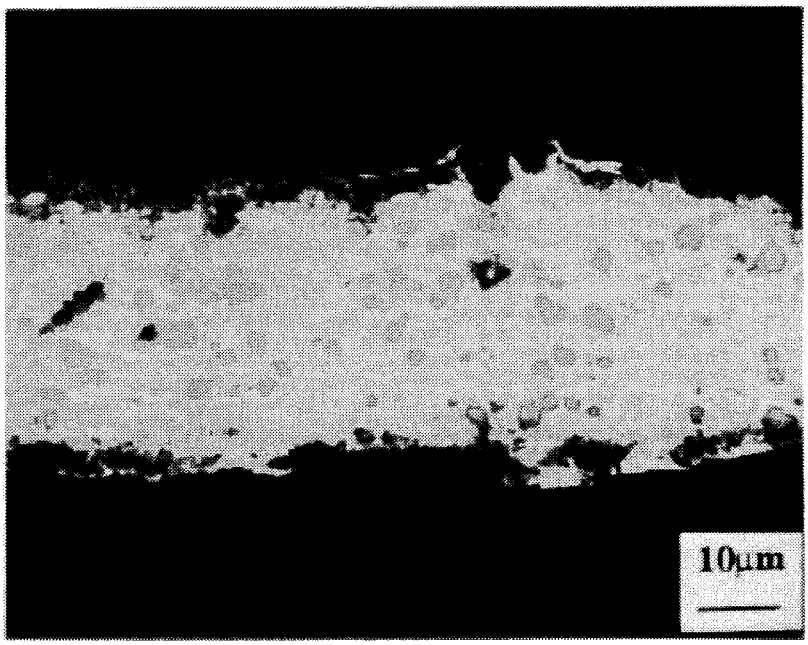
FIG. 3 is an optical photomicrograph taken at 100× magnification of the microstructure of the foil of FIG. 1 after reduction in thickness by cold-rolling, as viewed in a cross-section through the thickness of the foil and parallel to the rolling direction.

The Al-11.6Si foil was cold-rolled about 90% from a thickness of about 0.0106 in. to about 0.0012 in., without a substantial amount of edge cracking, and without stress relief annealing. A substantial amount of edge cracking would include edge cracking which has begun to propagate beyond the edge and into the interior of the foil. This is in contrast to small amounts of edge cracking that are usually associated with cold-rolled materials. FIG. 3 is a photomicrograph taken at 500× magnification of a cross-section of the as-rolled foil of FIG. 1 taken parallel to the rolling direction after about 77% reduction, and indicates that the Si particles are still intact and evenly distributed throughout the Al solid-solution matrix.

Figure 4:
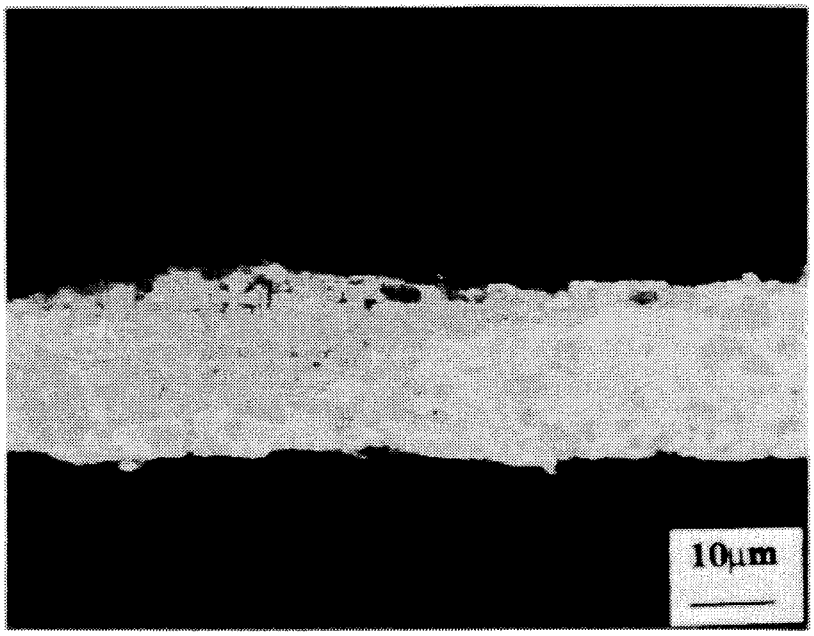
FIG. 4 is an optical photomicrograph taken at 100× magnification of the microstructure of the foil of FIG. 2 after reduction in thickness by cold-rolling, as viewed in a cross-section through the thickness of the foil and parallel to the rolling direction.

The Al-11.6Si+25 vol/o Si foil was also cold-rolled about 90% from a thickness of about 0.0106 in. to about 0.0012 in., without stress relief annealing. Some edge cracking was observed in this foil, but the cracks did not propagate into the bulk of the foil. After about 30% reduction, one longitudinal (parallel to the rolling direction) crack initiated at one end of the sample, and this crack grew down the length of the sample with subsequent cold-rolling. However, there was no additional cracking in the bulk of the material. As shown in FIG. 4, which is an optical photomicrograph taken at 500× magnification of a cross-section of the as-rolled foil of FIG. 2 taken parallel to the rolling direction after 90% reduction in thickness, the large Si particles were cracked, and in many cases were cracked into small pieces that were strung out along the rolling direction. However, this foil also exhibited substantial ductility.

Within the resolution of the optical microscope, no cracks were seen in the small Si particles in either foil. The excellent cold-rollability of these foils is probably due to the fine grain size of the Al matrix.

This description and example are intended only to be descriptive of the embodiments set forth herein, and should not be construed as limiting the invention to these embodiments.

What is claimed is:

1. A foil of an alloy consisting essentially of Al and Si (Al—Si alloy), said foil having a thickness less than or equal to 0.017 in. and sufficient ductility to permit cold-rolling of said foil.

2. The foil of claim 1, wherein said Al—Si alloy has a Si content in the range of 11.6–25 percent by weight.

3. The foil of claim 2, wherein said Al—Si alloy also contains a quantity of excess Si particles that comprise up to 25 volume percent of the foil, wherein said foil is formed by hot pressing a mixture comprising a plurality of Al—Si alloy particles and a plurality of Si particles.

4. The foil of claim 3, wherein the Si particles in said foil have a diameter of about 30–50 microns.

5. The foil of claim 1, wherein said Al—Si alloy has a composition comprising about 50% or more of Al by volume, such that an Al solid-solution alpha phase is a primary phase and an Si solid-solution beta phase is a secondary phase.

6. The foil of claim 5, wherein the primary phase particles have an average grain size of about 10 microns or smaller and the secondary phase has a main size of 5 microns or smaller.

7. The foil of claim 2, wherein said Al—Si alloy is ductile and adapted to be reduced in thickness by cold-rolling by at least about 10% in a single cold-rolling step without causing substantial edge cracking within said foil.

8. The foil of claim 2, wherein said Al—Si alloy is ductile and adapted to be reduced in thickness by cold-rolling by at least about 90% in a plurality of cold-rolling steps without causing substantial edge cracking within said foil.

9. An Al—Si alloy foil having a thickness less than or equal to 0.017 in. made by a method, comprising the steps of:

hot pressing an Al—Si alloy powder located within a means for holding so as to directly form said Al—Si alloy foil from the Al—Si alloy powder; and removing the means for holding from said Al—Si alloy foil.

10. The foil of claim 9, made by the method further comprising the step of rolling said Al—Si alloy following the step of removing the means for holding, whereby the thickness of said foil is reduced.

11. The foil of claim 9, wherein hot pressing comprises hot isostatic pressing.

12. The foil of claim 9, wherein said Al—Si alloy has a Si content in the range of 11.6–25 percent by weight.

13. An Al—Si alloy foil made by the method, comprising the steps of:

selecting an Al—Si alloy powder;

loading the Al—Si alloy powder into a means for holding;

evacuating the means for holding;

hot pressing the means for holding to form an Al—Si alloy foil directly from the Al—Si alloy powder; and removing the means for holding from the Al—Si alloy foil.

14. The foil of claim 13, wherein said Al—Si alloy has a composition comprising about 50% or more of Al by volume, such that an Al solid-solution alpha phase is a primary phase and an Si solid-solution beta phase is a secondary phase.

15. The foil of claim 14, made by the method further comprising the step of rolling said Al—Si alloy following the step of removing the means for holding, whereby said foil is reduced in thickness.

16. The foil of claim 15, made by the method further comprising the step of heat treating the Al—Si alloy after the step of rolling, to relieve internal stresses.

17. The foil of claim 16, made by the method wherein the steps of rolling and heat treating are repeated at least once, except that the step of heat treating after the final step of rolling is optional.

* * * * *